United States Patent [19]

Smart

[11] Patent Number: 4,847,203

[45] Date of Patent: Jul. 11, 1989

[54] FERMENTATION VESSELS

[75] Inventor: Nigel J. Smart, Mississauga, Canada

[73] Assignee: Allelix, Inc., Mississauga, Canada

[21] Appl. No.: 90,906

[22] Filed: Aug. 31, 1987

[51] Int. Cl.[4] ..... B01F 3/04

[52] U.S. Cl. ..... 435/314; 435/313; 261/5; 261/77; 261/123; 261/124; 261/126; 210/195.4; 366/107

[58] Field of Search ..... 261/123, 77, 5, 6, 124, 261/126; 435/313, 314, 315, 316, 818; 210/195.4; 366/101, 106, 107

[56] References Cited

U.S. PATENT DOCUMENTS

| | | | |
|---|---|---|---|
| 642,460 | 1/1900 | Kersten | 435/314 X |
| 2,083,348 | 6/1937 | Scholler et al. | 435/314 |
| 3,216,573 | 11/1965 | Irion | 261/123 X |
| 3,339,741 | 9/1967 | Bernard et al. | 210/195.4 |
| 3,385,444 | 5/1968 | Dufournet | 210/195.4 |
| 3,829,070 | 8/1974 | Reba et al. | 261/77 |
| 4,198,359 | 4/1980 | Todd | 261/123 X |
| 4,210,613 | 7/1980 | Webb | 261/123 X |
| 4,465,645 | 8/1984 | Kaelin | 261/123 X |
| 4,545,945 | 10/1985 | Prave et al. | 261/123 X |
| 4,649,117 | 3/1987 | Familletti | 435/313 |
| 4,717,669 | 1/1988 | Feres et al. | 435/315 |

FOREIGN PATENT DOCUMENTS

| | | | |
|---|---|---|---|
| 86/07604 | 12/1986 | PCT Int'l Appl. | 435/314 |
| 86/07605 | 12/1986 | PCT Int'l Appl. | 435/314 |
| 0544675 | 1/1977 | U.S.S.R. | 435/313 |
| 2037174 | 7/1980 | United Kingdom | 210/195.4 |

OTHER PUBLICATIONS

PCT 86/07605, U.S. Cell Tech. Limited, Thompson et al, 12/1986.

Feder et al, "The Large-Scale Cultivation of Mammalian Cells", Scientific American, Jan. 1983, vol. 248, No. 1, pp. 36-43.

*Primary Examiner*—Albert J. Makay

*Assistant Examiner*—Carl D. Price

*Attorney, Agent, or Firm*—Wyatt, Gerber, Burke and Badie

[57] ABSTRACT

A fermentation vessel comprises an outer shell, and an annular draft tube located within the shell and spaced therefrom to promote continuous circulation of fluids through said draft tube within said shell. The draft tube has an internal cavity located within its walls. The cavity is connected to a fluid supply conduit that extends externally of the shell. A plurality of discrete nozzles are disposed about the circumference of the tube and communicate with the cavity to permit egress of fluids from the cavity to the interior of the shell to promote circulation.

6 Claims, 3 Drawing Sheets

FERMENTATION VESSELS

Fermentation vessels are used to provide optimum conditions for a fermentation process and promote the growth of cells to provide a desired by-product. One factor important in the design of fermentation vessels is that there be a homogeneous broth within the fermentation vessel which is normally achieved by promoting circulation of the broth. Various devices are proposed for promoting such circulation including a mechanical stirrer. However, for certain applications most notably the more complex plant and animal cell structures, mechanical stirrers may cause damage to the cells.

It has also been proposed to use an airlift system to generate circulation. An airlift system uses a central draft tube to establish a circulation pattern within the fermentation vessel and air is supplied to the fermentation broth so that the bulk density of the broth enclosed by the tube is reduced causing an upward movement of the broth. This is accompanied by a downward movement of the balance of the broth so that a circulation pattern is established through the tube and down the outside of the tube. Such an arrangement is shown in PCT application 86/07605 to Celltech.

In this arrangement however, the air is supplied through a central inlet which may cause excessive turbulence leading to shear damaging sensitive cells. Moreover, it has been observed that the size of the air bubble has a major effect on the system's ability to transfer oxygen and produce viable cell populations. The single central air supply shown in the above-noted patent application tends to produce bubbles of large size if sufficient oxygen is supplied to the broth to support fermentation.

It is therefore an object of the present invention to provide a fermentation vessel in which the above disadvantages are obviated or mitigated.

According therefore to one aspect of the present invention there is provided a fermentation vessel comprising an outer shell, an annular draft tube located within said shell and spaced therefrom to promote continuous circulation of fluids through said draft tube within said shell, said draft tube having an internal cavity located within the walls thereof and connected to a fluid supply conduit extending externally of said shell and a plurality of discrete nozzles disposed about the circumference of said tube and communicating with said cavity to permit egress of fluids from said cavity to the interior of said shell.

Preferably, the nozzles are directed radially inwardly of the draft tube and are also disposed circumferentially about a lower edge of the draft tube. In this way a central air supply is avoided and a number of discrete outlets for the air is provided in an economical manner.

A further aspect of the invention provides a fermentation vessel comprising an outer shell, an annular draft tube located within said shell and spaced therefrom to promote circulation within said vessel and a filter member encompassing said tube and spaced therefrom to divide said shell into a pair of zones.

Preferably the draft tube has a hollow interior connected to the interior of the shell through nozzles to provide a number of discrete outlets for air supplied to the interior of the draft tube. The provision of the filter member enables the broth to be filtered and continuously removed without depleting the cell population within the fermentation vessel. At the same time, the operation of the draft tube is unimpeded.

According also to the present invention there is provided a fermentation vessel comprising a shell to contain a fermentation broth, an outlet conduit to maintain said broth at a predetermined level within said shell, a first elongate baffle spaced from the walls of said shell and terminating below the outlet conduit to permit counter flow of fluid along opposite sides of said baffle, means to induce upward flow of fluid along one side of said baffle, a second elongate baffle disposed on the opposite side of said first baffle and co-operating with said shell to define a separate settling zone within said shell in communication with said outlet conduit, said second baffle having means to provide an inlet to permit fluid to flow into said settling zone and an outlet to permit fluid to flow from said settling zone into the fermenting broth with said inlet being disposed above said outlet.

By providing spaced inlets and outlets for the settlement zone, a continuous circulation of broth is provided into the settlement zone and the downward flow from the inlet to the outlet enhances the gravitational settlement of the cell structures within the settlement zone.

Embodiments of the invention will now be described by way of example only with reference to the accompanying drawings in which.

Figure 1:
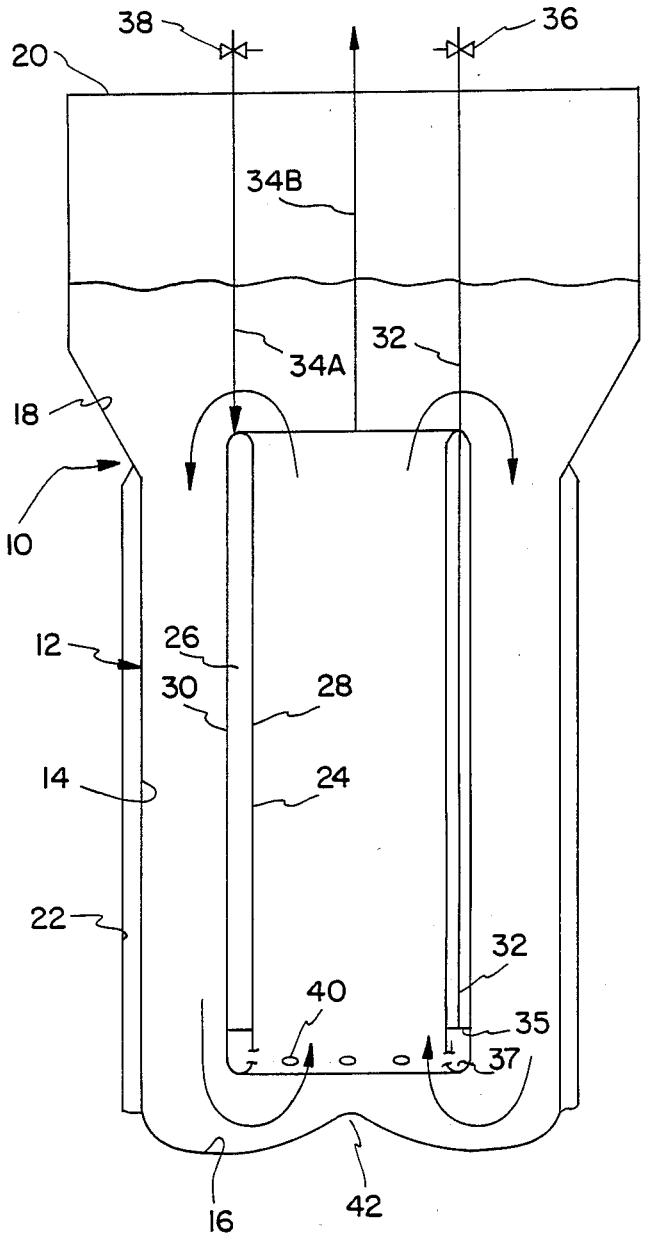
FIG. 1 is a side elevation of a fermentation vessel.

Referring to FIG. 1, a fermentation vessel 10 includes a shell 12 having sidewalls 14 and an end wall 16. The side walls 14 outwardly flare as indicated at 18 and extend upwardly to a cover 20. When assembled, the sidewalls 14, base 16 and cover 20 form a sealed unit.

Disposed about the sidewalls 14 is a jacket 22 having a dimpled outer surface to increase the surface area and promote heat transfer between the shell and the surrounding environment.

Disposed within the shell 14 is an annular draft tube 24. The draft tube 24 is formed with an internal chamber 26 defined by a pair of opposed sidewalls 28, 30. The sidewalls 28, 30 are connected at opposite ends to form a unitary structure and an internal partition 35 defines an annular internal cavity 37 at the lower end of the tube 24. A gas supply conduit 32 passes through the cover 20 and between the sidewalls 28, 30 to the partition 35. The conduit 32 delivers a gas of suitable composition, such as air to the cavity 37. A liquid supply and return conduit 34*a*, 34*b* also pass through the cover 20 and are connected to the chamber 26. The conduits 34 are connected to a supply of liquid which may be supplied at an elevated temperature to increase the temperature within the shell 14. Supply to the conduits 32, 34 is controlled by valves 36, 38 respectively in a known manner.

Figure 2:
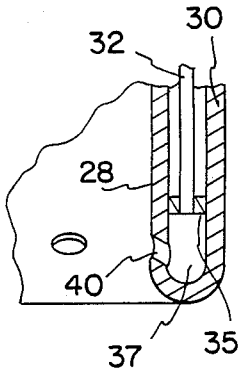
FIG. 2 is an enlarged view of a portion of the fermentation vessel shown in FIG. 1.

Disposed at the lower edge of the draft tube 24 is a series of nozzles 40 which are seen in greater detail in FIG. 2. Each of the nozzles 40 extends through the sidewall 28 to communicate with the interior of cavity 37. The axis of each of the nozzles 40 is inclined upwardly at an angle of 45° relative to the longitudinal axis of the draft tube 24. The nozzles 40 are uniformly spaced about the inner circumference of the tube 24 and are sized to provide air bubbles of an appropriate size, typically 8 mm in diameter.

It will be seen from FIG. 1 that the end wall 16 is contoured to provide an upwardly directed cusp 42 aligned with the longitudinal axis of the draft tube 24. The end wall 16 is smoothly curved from the cusp to the sidewalls 14.

In operation, the fermentation broth is placed within the shell 12 and incubation promoted by the supply of liquid through the conduits 34 to the internal chamber 26. Once incubation has been completed, the valve 38 is closed and the gas with suitable composition is supplied through the conduit 32 to the internal cavity 37. The walls 28, 30 and partition 35 are impervious and so the air flows through the nozzles 40 into the interior of the draft tube 24. The provision of the air within the fermentation broth produces a reduced bulk density within the tube that causes an upward movement of the broth along the axis of the tube. This is accompanied by a downward movement of the broth outside the tube 24 so that a circulation pattern as indicated by the arrows is established with the fermentation vessel. The provision of the air from a number of locations reduces the shear forces within the broth and therefore provides a gentle transport of the cell structures. Moreover, the number and size of the nozzles 40 can be chosen to produce the optimum bubble size for promoting transfer of the oxygen to the cell structure and maintaining the desired flow of oxygen to the fermentation broth.

The smoothly contoured end wall 16 also assists in reducing the hydraulic forces upon the broth to maximize the hydraulic slip of the broth within the fermentation vessel.

Of course the fermentation process will be monitored by sensors in the normal manner, but these have not been included for clarity of description.

If preferred, the sidewalls 28, 30 above the partition 37 could be made porous to allow filtering and removal of the broth through the chamber 26 although such an arrangement would reduce the ability to supply fluid to the chamber during incubation.

Figure 3:
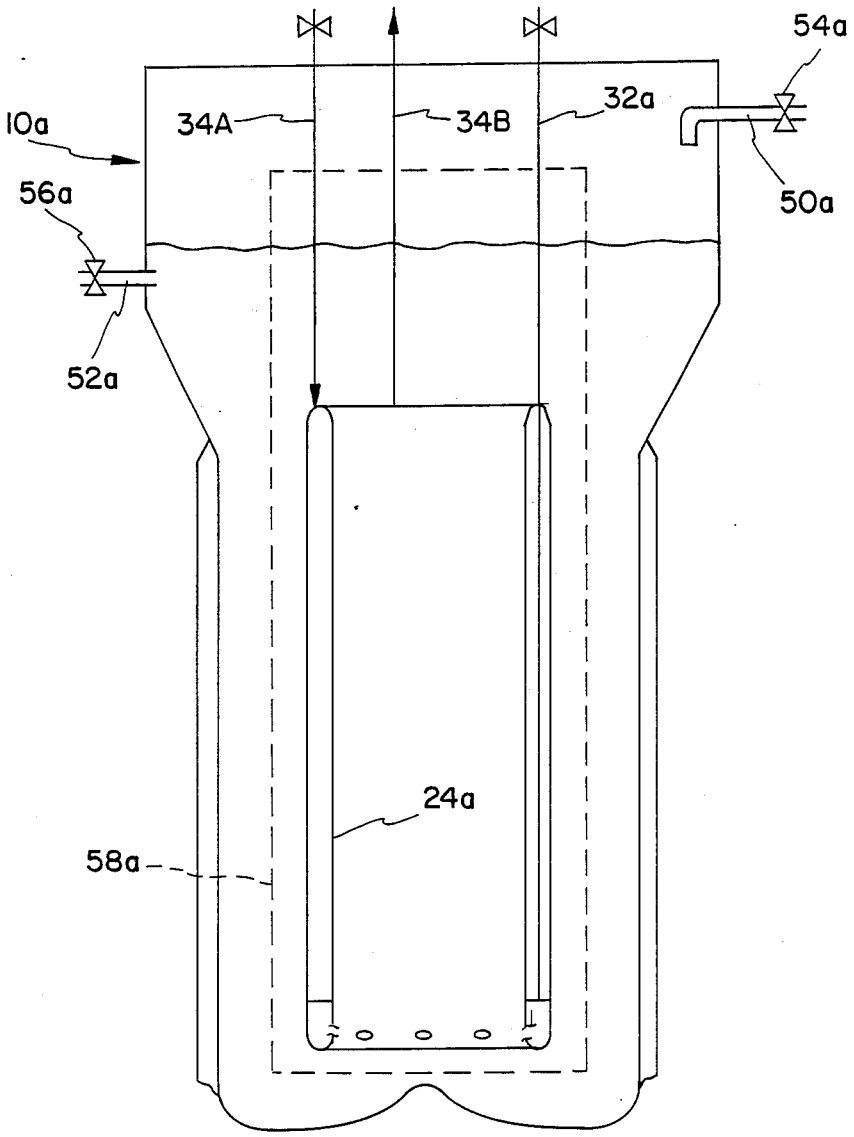
FIG. 3 is a side elevation similar to that of FIG. 1 showing an alternative embodiment of fermentation vessel.

An alternative embodiment is shown in FIG. 3 in which like components will be identified by like reference numerals with the suffix "a" added for clarity. The operation of the draft tube is identical to that described above with reference to FIGS. 1 and 2 and will not therefore be described in further detail.

The fermentation vessel 10*a* is provided with an inlet 50*a* and an outlet 52*a* controlled by valves 54*a*, 56*a* respectively. This permits the continuous processing of liquid media by establishing similar flows through the inlet and outlet 50*a*, 52*a*. To avoid the loss of cells and a corresponding reduction in the cell population in the broth, a filter member 58*a* is disposed around the draft tube 24*a*. The filter member may be of any convenient form, but is most suitably a stainless steel or nylon mesh with the appropriate mesh size opening. The filter member 58*a* is generally cylindrical with top and bottom closure panels. The filter member 58*a* is spaced from the draft tube 24*a* so that circulation of the cell-containing broth may still proceed in the normal manner. However, the filter member 58 has a mesh size appropriate to prevent cells from passing through to the outlet 58*a* and therefore retains the cell population.

Figure 4:
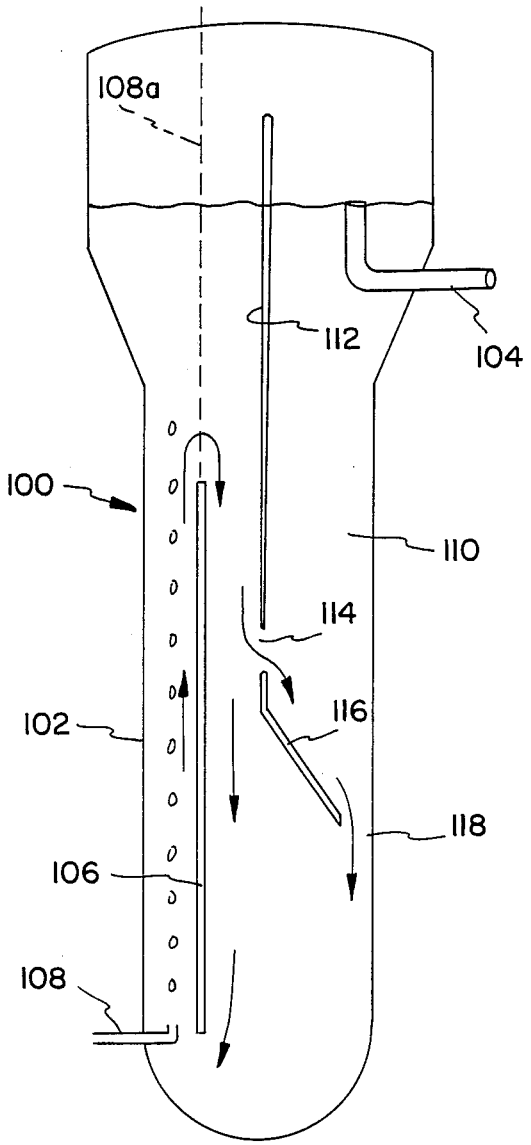
FIG. 4 is a sectional elevation of a further embodiment of fermentation vessel.

In some instances, it is preferable to allow for separation of the cell structures under the influence of gravity by providing a settlement zone within the shell 14. Such a fermentation vessel is shown in FIG. 4.

The fermentation vessel 100 comprises an outer shell 102 provided with the normal fluid inlets and sensing devices that are not shown for clarity. An outlet conduit 104 is disposed within the shell 102 with the upper end of the conduit 104 determining the height of broth within the shell 102.

An elongate baffle 106 is disposed within the shell 102 and to one side of its longitudinal axis. The baffle 106 terminates below the level of broth within the vessel and above the end wall of the shell 102.

A sparger 108 is provided at the lower end of the baffle 106 to receive a gaseous supply and promote a reduction in the bulk density of the fermentation broth disposed between the baffle 106 and the wall of the shell 102. The sparger promotes flow of fluid through the introduction of gas bubbles up one side of the baffle and down the opposite side in a manner indicated by the arrows so that a homogeneous mixture is maintained within the shell. Alternatively the baffle 106 may be formed with an internal cavity at its lower end with nozzle 40*a* directed to one side of the baffle 106 in the manner shown in FIG. 2 and gas supplied by a conduit 108*a* indicated in chain dot line in FIG. 4.

To permit separation of the clarified liquid, a settlement zone indicated at 110 is provided by a baffle 112. The baffle 112 extends above the level of the outlet pipe 104 and co-operates with the shell to separate the settlement zone 110 from the balance of the fermentation broth.

An aperture 114 is provided in the baffle 112 to provide an inlet to the settlement zone 110. The baffle 112 includes a downwardly inclined portion 116 that terminates before the shell wall 102 to provide an outlet 118.

In normal operation, circulation of the fermentation broth is established by the sparger 108 and a portion of the downwardly moving fluid is diverted through the inlet 114 into the settlement zone 110. In the settlement zone the cells will tend to gravitate towards the base of the zone and through the outlet 118 leaving the clarified broth in the upper area of the settlement zone 110 for removal through the outlet 104. The broth within the settlement zone is continuously replenished by the flow between the inlet and outlet 114, 118 and the downward flow of the broth between the inlet and outlet promotes the settling of the cells within the settlement chamber.

We claim:

1. A fermentation vessel to contain and ferment a fermentation broth comprising an outer shell having an inner wall; an annular vertically aligned draft tube located within said shell, said draft tube having a lower edge, an inner wall, an outer wall and a partition between said inner and outer walls, said walls and partition defining a lower internal cavity and upper chamber therebetween, said draft tube being spaced from said shell to promote continuous circulation of said broth through said draft tube and within said shell, fluid flow inlet and outlet lines extending internally of said vessel and in fluid flow communication with said upper chamber, a plurality of discrete orifices in communication with said internal cavity and disposed about the circumference of the inner wall of said tube proximate said lower edge; a gas supply conduit extending externally of said shell and extending internally of said vessel to and in gas flow communication with said internal cavity, said orifices arranged for ejecting said gas from said internal cavity to within the draft tube interior wall in order to air-lift said broth to the interior of said shell between the inner wall of the shell and the outer wall of the draft tube.

2. A fermentation vessel according to claim 1 wherein said nozzles are directed radially inwardly of said draft tube.

3. A fermentation vessel according to claim 1 wherein said orifices are directed upwardly relative to said draft tube.

4. A fermentation vessel according to claim 3 wherein said orifices are directed at an angle of 45° relative to the longitudinal axis of said draft tube.

5. A fermentation vessel according to claim 1 wherein said shell has a lower surface disposed beneath said tube, said lower surface being formed as a cusp located substantially on the longitudinal axis of said tube.

6. A fermentation vessel according to claim 1 wherein a filter member is disposed between said tube and said shell to subdivide the interior of said shell into a pair of zones.

* * * * *